US005800207A

United States Patent [19]

Hsu et al.

[11] Patent Number: 5,800,207

[45] Date of Patent: Sep. 1, 1998

[54] MECHANISM FOR ARRANGING DIFFERENT I/O PORT CONNECTORS

[75] Inventors: Sung Liu Hsu, Lin-Kou Hsiang; Chun Chu Wang, Pan-Chiao; Chang-Hua Yin, Hsin-Tien, all of Taiwan

[73] Assignee: Hon Hai Precision Ind. Co., Ltd., Taipei, Taiwan

[21] Appl. No.: 651,565

[22] Filed: May 22, 1996

[51] Int. Cl.[6] ..... H01R 13/66

[52] U.S. Cl. ..... 439/541.5; 439/607

[58] Field of Search ..... 439/541.5, 540, 439/701, 540.1, 79, 607

[56] References Cited

U.S. PATENT DOCUMENTS 5,336,109 8/1994 Hillbish et al. ..... 439/541.5

5,643,008 7/1997 Tan et al. ..... 439/541.5

*Primary Examiner*—Khiem Nguyen

*Assistant Examiner*—Eugene G. Byrd

[57] ABSTRACT

A bracket (10) includes a pair of side stands (12) spaced away from but interconnected with each other by respectively a supporting bar (14) formed on the front upper portions (17) thereof for supportably mounting a connector (22) thereon and/or a spacer bar (16) formed on the rear lower portions (19) thereof for aligning contact tails (30) of the connector (22). Each side stand (12) includes its own boardlock (48) for directly mounting the bracket (10) onto the mother board (100). An L-shaped partition bar (42) is connected between the supporting bar (14) and the spacer bar (16) for separating the space under the supporting bar (14) to smaller ones for accommodating plural less sized connectors (66) or components therein.

12 Claims, 3 Drawing Sheets

MECHANISM FOR ARRANGING DIFFERENT I/O PORT CONNECTORS

BACKGROUND OF THE INVENTION

1. Field of the Invention

The invention relates to mechanism for arranging different type connectors at different levels, and particularly to an insulative bracket for use with different type connectors having different lengthwise dimensions and arranged at different levels.

2. The Prior Art

Different I/O (Input/Output) port connectors are popularly used in the computer field, and how to efficiently arrange such plenty different I/O connectors around the backpanel of the computer case within a limited tiny room is substantially a good research issue for every computer manufacturer. Some attempts have been taken to stack the similar connectors together or have one connector with dual ports. U.S. Pat. Nos. 5,037,330, 5,080,609, 5,085,590 and 5,336,109 disclose some designs for arrangement of the stacked type connector assembly generally with a frame or bracket combining the upper connector and the lower connector together.

Anyhow, in the recent years, various connectors are introduced to be used within the computer for connecting to different peripheries. Therefore, a structure is desired to have various connectors arranged in the limited space, not only easily and efficiently, but also stably, reliably and flexibly.

An object of the invention is to provide a bracket defining at least two level sections for either fastening the different connectors to the different levels thereof and/or separating the different connectors in different sections thereof.

SUMMARY OF THE INVENTION

According to an aspect of the invention, a bracket includes a pair of side stands spaced away from but interconnected with each other by a supporting bar formed on the front upper portions thereof and/or a spacer bar formed on the rear lower portions thereof, respectively. Each side stand includes its own boardlock for directly mounting the bracket onto the mother board. A L-shaped partition bar is connected between the supporting bar and the spacer bar for separating the space under the supporting bar to smaller ones for accommodating plural less sized connectors or components therein.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
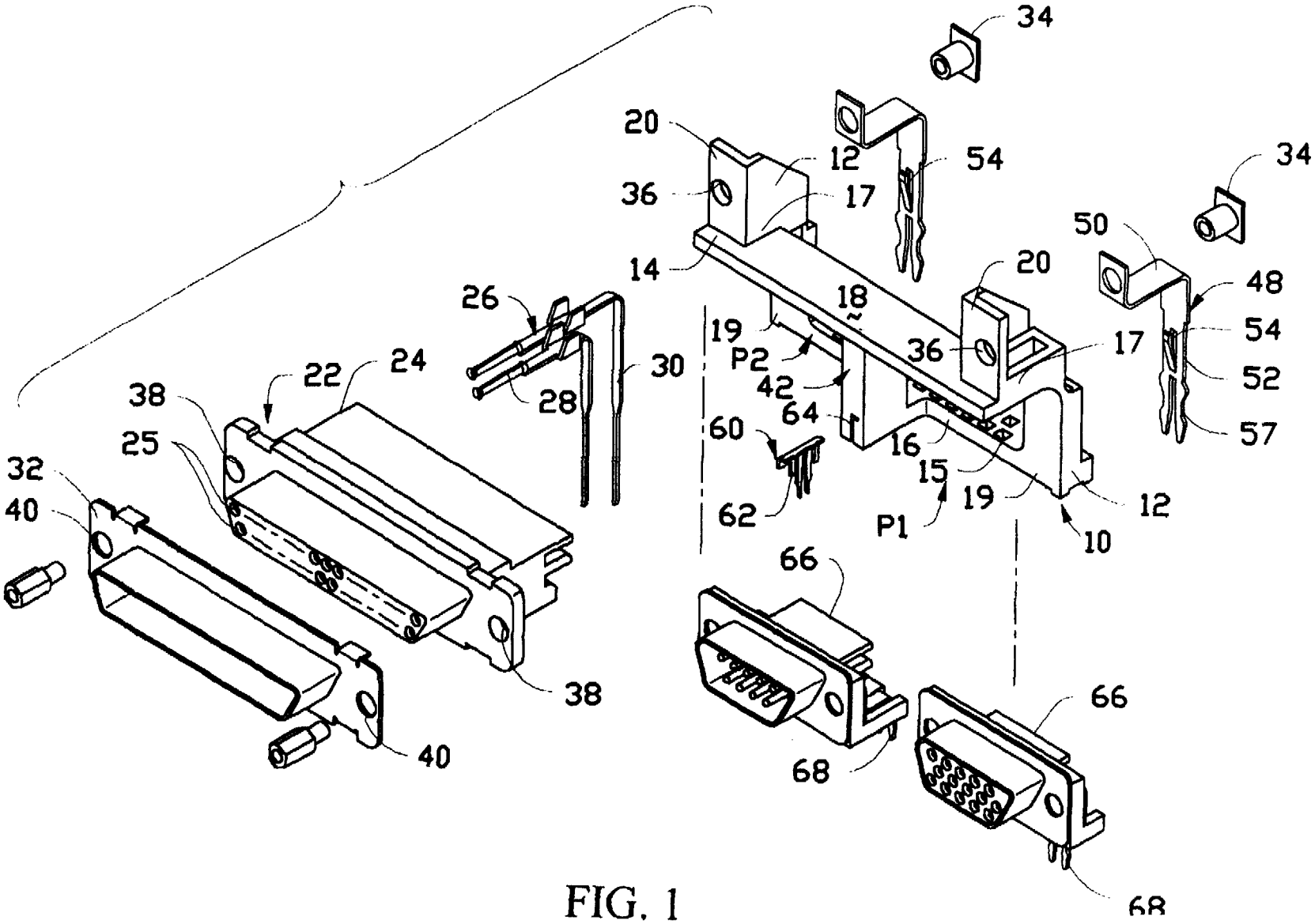
FIG. 1 is an exploded view of a presently preferred embodiment of a bracket for use with. a 25-pin D-Sub connector at the higher level and two 15-pin D-Sub connectors at the lower level.
Figure 2:
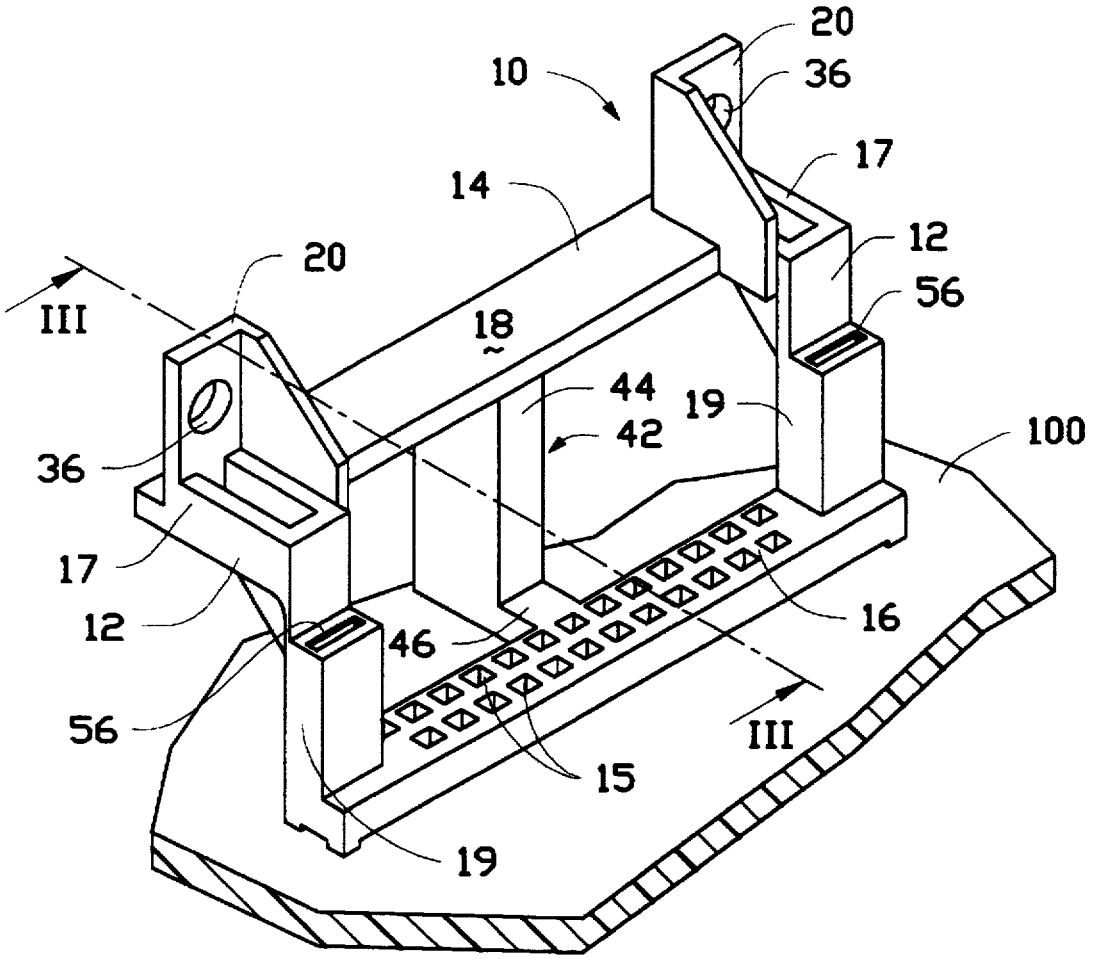
FIG. 2 is a perspective view of the bracket of FIG. 1 without the boardlocks thereon to show the back side thereof.
Figure 3:
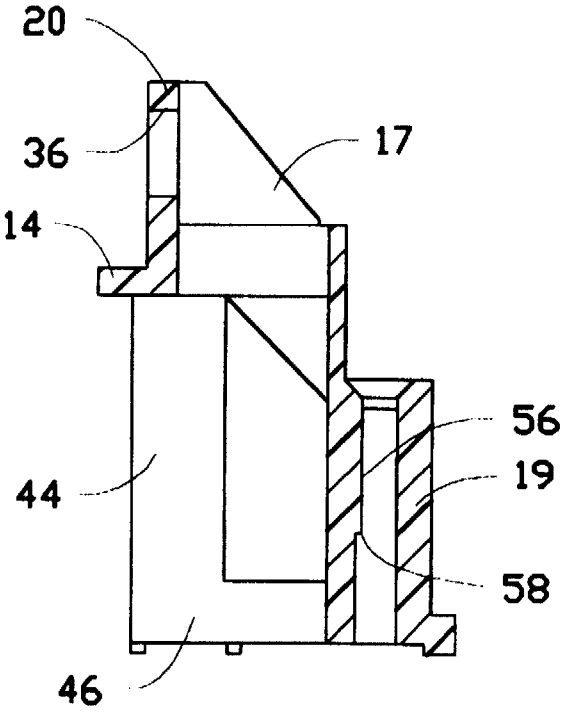
FIG. 3 is a cross-sectional view of the bracket of FIG. 1 along line III—III to show the side stand and its interior.

It will be noted here that for a better understanding, most of like components are designated by like reference numerals throughout the various figures in the embodiments. Attention is directed to FIGS. 1–3 wherein the subject bracket 10 includes a pair of side stands 12, and a supporting bar 14 are integrally formed between the upper portions 17 thereof and a spacer bar 16 are formed between the lower portions 19 thereof respectively.

The supporting bar 14 provides an upward facing supporting plane 18 cooperating with two vertical abutting walls 20 respectively on two side stands 12 to hold a 25-pin D-Sub connector 22 thereon. Such 25-pin D-Sub connector 22 includes an insulative body 24 defining a plurality of passageways 25 for receiving therein a plurality of contacts 26 wherein each contacts 26 has a contact portion 28 within the corresponding passageway 25 and a long tail portion 30 extending downward on the rear portion. A shell 32 is attached to the body 24.

Thus, the whole connector 22 can be fastened to the bracket 10 by its body 24 respectively supportably seated on the supporting plane 18 of the supporting bar 14 and abutting against the abutting walls 20 of the side stands 12 and by a pair of rivets 34 extending through the corresponding holes 36 in the abutting walls 20, the holes 38 in the body 24 and the holes 40 in the shell 32. Under this situation, the tail portions 30 of the contacts 26 substantially extend respectively through the corresponding through holes 15 in the spacer bar 16 for efficient alignment with the apertures (not shown) in the PC board 100 (FIG. 2) on which the bracket 10 and the associated connector 22 are mounted.

The feature of the invention further includes provision of a L-shaped partition bar 42 comprised of a vertical section 44 and a horizontal section 46 respectively connected to the supporting bar 14 and the spacer bar 16. The horizontal section 46 cooperates with the spacer bar 16 to provide stability of the whole bracket 10 on the board 100 on which the bracket 10 with the associated connector 22 is seated. It can be seen that the vertical section 44, is generally supportably below the supporting bar 14 opposite to the connector 22 which is positioned above the plane 18 of the supporting bar 16.

It is noted that a pair of boardlocks 48 are positioned on the tow opposite side stands 12, respectively wherein each boardlock 48 includes an L-shaped abutting section 50 in compliance with the L-shaped upper portion 17 of the side for securement with the connector 22 with the rivet 34, and a downward strip section 52 with a tang 54 sprung outward. The whole strip section 52 may extend through the passage 56 (FIG. 2) in the lower portion 19 of the side stand 12 whereby the distal fork end 57 of the strip section 52 may protrude out of the bottom of the side stand for retaining the whole bracket 10 on the mother board 100, and the tang 54 may engage the internal step 58 in the passage 56 (FIG. 3) for prevent an upward back movement of the strip section 52.

An auxiliary boardlock 60 is provided around the intersection corner of the vertical section 44 and the horizontal section 46 of the L-shaped partition bar 42 wherein the auxiliary boardlock 60 has an securing section 62 on the top for interferentially received within a slot 64 in the L-shaped partition bar 42. Therefore, the bracket 10 with the connector 22 thereon can be sufficiently mounted on the mother board 100 through these three commonly coplanar but not collinear boardlocks 48, 60.

The L-shaped partition bar 42 further defines a pair of two separate spaces P1 and P2 respective on two sides of the partition bar 42 and under the supporting bar 14. These two smaller rooms provide proper spaces to locate therein a pair of 15-Pin D-Sub connectors 66 wherein each connector 66 has its own boardlocks 68 for self-securement with regard to the mother board 100. In other words, the bracket 10 substantially provides an arrangement for managing the planar relationship between the small connectors 66 with regard to the bracket 10 by having the L-shaped partition bar 42 intermediate between such two connectors 66 in the horizontal direction, and managing the vertical relationship between the small connectors 66 and the large connector 22 by means of the supporting bar 14 generally intermediating therebetween in the vertical direction.

It can be appreciated that in the embodiment of the invention, the lower level connectors 66 are not secured to the bracket 10, and the bracket 10 generally provides the structures with the spaces below for allowing the lower level connectors 66 are substantially located under the upper lever connector 22. Moreover, it should be contemplated that the lower lever small sized connector 66 may be other type electrical components which is generally permanently soldered on the mother board 100 in other embodiments.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A bracket for use with two-level connectors for mounting on a board, comprising:

a pair of side stands interconnected with each other by a supporting bar integrally connected between two upper portions thereof, and by a spacer bar integrally connected between two lower portions thereof; wherein the supporting bar includes a supporting plane for mounting a first connector thereon and the spacer bar includes a plurality of through holes therein for alignment of contact tails of said first connector;

a partition bar integrally extending from at least one of the supporting bar and the spacer bar.

2. The bracket as described in claim 1, wherein said partition bar substantially connected between and to both the supporting bar and the spacer bar.

3. The bracket as described in claim 2, wherein said partition bar is of an L-shaped configuration, including a vertical section and a horizontal section respectively connected to the supporting bar and the spacer bar.

4. A bracket for use with two-level connectors for mounting on a board, comprising:

a pair of side stands interconnected with each other by a supporting bar integrally connected between two upper portions thereof, and by a spacer bar integrally connected between two lower portions thereof; wherein the supporting bar includes a supporting plane for mounting a first connector thereon and the spacer bar includes a plurality of through holes therein for alignment of contact tails of said first connector;

a pair of boardlocks respectively positioned adjacent the two opposite side stands.

5. The bracket as described in claim 4, wherein said bracket further includes a partition bar with an auxiliary boardlock thereon so that the boardlocks on two side stands and the auxiliary boardlock incorporate with each other to form three coplanar but not collinear points on the board.

6. The bracket as described in claim 4, wherein each of two side stands has a passage to retainably receive a strip section of the boardlock therein.

7. An arrangement of an electrical connector assembly mounted on a board, comprising:

a bracket including a pair of side stands interconnected by a supporting bar integrally formed between upper portions thereof so as to define an upper level and a lower level thereof;

a first connector secured to the bracket and supported by said supporting bar and substantially at the upper level; and a second connector directly solderably and mountably secured to the board and substantially at the lower lever without any securement with the bracket;

a spacer bar formed integrally between lower portions of said two opposite side stands, with a plurality of through holes for alignment of contact tails of the first connector.

8. The arrangement as described in claim 7, wherein a partition bar respectively connected to the supporting bar and the spacer bar.

9. An arrangement of an electrical connector assembly mounted on a board, comprising:

a bracket including a pair of side stands interconnected by a supporting bar integrally formed between upper portions thereof so as to define an upper level and a lower level thereof;

a first connector secured to the bracket and supported by said supporting bar and substantially at the upper level; and a second connector directly solderably and mountably secured to the board and substantially at the lower lever without any securement with the bracket;

a partition bar integrally extends downward from the supporting bar for dividing the lower level to two spaces.

10. The arrangement as described in claim 9, wherein the partition bar includes an auxiliary boardlock on its distal end.

11. An arrangement of an electrical connector assembly mounted on a board, comprising:

a bracket including a pair of side stands interconnected by a supporting bar integrally formed between upper portions thereof so as to define an upper level and a lower level thereof;

a first connector secured to the bracket and supported by said supporting bar and substantially at the upper level; and a second connector directly solderably and mountably secured to the board and substantially at the lower lever without any securement with the bracket;

wherein said first connector is substantially longer than the second connector.

12. An arrangement of an electrical connector assembly mounted on a board, comprising:

a bracket including a pair of side stands interconnected by a supporting bar integrally formed between upper portions thereof so as to define an upper level and a lower level thereof;

a first connector secured to the bracket and supported by said supporting bar and substantially at the upper level; and a second connector directly solderably and mountably secured to the board and substantially at the lower lever without any securement with the bracket;

two boardlocks respectively on two side stands for securing the bracket onto the board.

* * * * *